US010166444B1

(12) United States Patent
Forshner

(10) Patent No.: US 10,166,444 B1
(45) Date of Patent: Jan. 1, 2019

(54) GOLF CLUB WITH REMOVABLE FACE

(71) Applicant: Acushnet Company, Fairhaven, MA (US)

(72) Inventor: Steven J. Forshner, Vista, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 15/863,693

(22) Filed: Jan. 5, 2018

Related U.S. Application Data

(63) Continuation-in-part of application No. 15/858,358, filed on Dec. 29, 2017.

(51) Int. Cl.
*A63B 53/04* (2015.01)

(52) U.S. Cl.
CPC .... *A63B 53/047* (2013.01); *A63B 2053/0416* (2013.01); *A63B 2053/0445* (2013.01)

(58) Field of Classification Search
CPC ..... A63B 53/047
See application file for complete search history.

(56) References Cited

U.S. PATENT DOCUMENTS

| | | | | |
|---|---|---|---|---|
| 1,349,805 | A | 8/1920 | Booth | |
| 4,540,178 | A | 9/1985 | Johnson et al. | |
| 4,883,275 | A * | 11/1989 | Boone | A63B 53/04 473/334 |
| 5,346,213 | A | 9/1994 | Yamada | |
| 5,509,660 | A * | 4/1996 | Elmer | A63B 53/04 473/288 |
| 6,080,068 | A | 6/2000 | Takeda | |
| 6,863,625 | B2 * | 3/2005 | Reyes | A63B 53/0466 473/330 |
| 6,923,733 | B2 * | 8/2005 | Chen | A63B 53/047 473/305 |
| 7,258,628 | B2 * | 8/2007 | Huang | A63B 53/0466 473/342 |
| 7,604,550 | B1 | 10/2009 | Currie | |
| 7,651,413 | B1 | 1/2010 | Chen | |
| 8,348,786 | B2 * | 1/2013 | Nakano | A63B 53/047 473/342 |
| 8,491,405 | B2 | 7/2013 | Jorgensen et al. | |
| 8,740,719 | B2 | 6/2014 | Wahl et al. | |
| 8,876,624 | B2 | 11/2014 | Ban et al. | |
| 2013/0090181 | A1 * | 4/2013 | Boyd | A63B 53/04 473/288 |

* cited by examiner

*Primary Examiner* — Michael Dennis
(74) *Attorney, Agent, or Firm* — Michael J. Mancuso

(57) ABSTRACT

The present invention is directed to a modular golf club. In particular, golf club includes a face component that is removably coupled so that the physical attributes of the golf club head may be altered.

19 Claims, 10 Drawing Sheets

GOLF CLUB WITH REMOVABLE FACE

CROSS-REFERENCE TO RELATED APPLICATIONS

This application is a continuation-in-part of U.S. patent application Ser. No. 15/858,358, filed Dec. 29, 2017, currently pending, the disclosure of which is incorporated herein by reference in its entirety.

FIELD OF THE INVENTION

This invention generally relates to golf clubs, and more specifically to a golf club having a removable face component.

BACKGROUND OF THE INVENTION

Iron-type golf clubs generally include a face that includes a ball striking surface and a body that supports the face, provides desired mass properties and includes a sole that is configured to contact the ground during a swing. The face includes a ball striking surface that generally includes a plurality of score lines or grooves that are positioned to impart spin to the ball during impact. Through repeated use, the score lines are known to wear, such as by dulling the edges of the score lines, thereby reducing the resultant spin imparted to the ball. The body is generally designed to provide mass that is distributed to tailor the behavior of the club, especially during impact with the ball.

Each golfer has a unique swing. It is impossible to design a golf club that is perfectly suited to every golfer. However, golf club designers are forced to provide a limited number of models that are intended to suffice for the majority of golfers. Typically, the construction of the golf club, especially for iron-type golf clubs, includes a single structural component that includes the body, the face, the sole and a hosel. In multi-material constructions, the parts of the golf club head are formed separately and then coupled during manufacturing of the club head, and the components are generally permanently coupled.

Some prior golf clubs have utilized multi-component constructions. For example, U.S. Pat. No. 5,346,213 describes a golf club head that includes a metal head body and a fiber reinforced resin face plate. A support pin extends through the body and retains the face plate.

In another multi-component golf club head construction, shown in U.S. Pat. No. 6,080,068, a golf club head includes a head attachment portion at the rear of a face that is horizontally connected to a base of a shaft attachment portion.

There is a need for an improved golf club construction that provides greater ability to alter the physical attributes of the golf club head by including removable components.

SUMMARY OF THE INVENTION

The present invention is directed to modular golf clubs. The inventive golf club includes a multi-component construction that includes a removable face component.

In an embodiment, a golf club head comprises a body, a face member, a top line key, and a threaded fastener. The body includes a recess having a heel side wall, a toe side wall, and a sole side wall defining a face support slot that is opened to a top line portion of the body. The body defines a threaded bore in a toe portion of the body. The face member is disposed in the face support slot and defines a ball striking surface. A plurality of score lines are recessed into the face member from the ball striking surface. The top line key forms a portion of a top line of the golf club head and extends in a heel to toe direction. The top line key defines an aperture in a toe portion of the top line key that aligns with the threaded bore of the body. The threaded fastener extends through the aperture of the top line key and is threaded into the threaded bore of the body. The fastener extends through the top line key and into the body to couple the top line key to the body. The top line key closes the opening of the face support slot, so that the face member is circumscribed by the heel side wall, the toe side wall, the sole side wall and the top line key.

In another embodiment, a golf club head comprises a body, a face member, a top line key, and a threaded fastener. The body includes a recess having a heel side wall, a toe side wall, and a sole side wall defining a face support slot that is opened to a top line portion of the body. The body defines a threaded bore in a toe portion of the body. The face member is disposed in the face support slot and defines a ball striking surface. A plurality of score lines are recessed into the face member from the ball striking surface. The top line key forms a portion of a top line of the golf club head and extends in a heel to toe direction. The top line key defines an aperture in a toe portion of the top line key that aligns with the threaded bore of the body. The threaded fastener extends through the aperture of the top line key and is threaded into the threaded bore of the body. The fastener extends through the top line key and into the body to couple the top line key to the body. The top line key closes the opening of the face support slot, so that the face member is circumscribed by the heel side wall, the toe side wall, the sole side wall and the top line key. The heel side wall of the recess defines an undercut, the toe side wall of the recess defines an undercut, and the face member includes rails on a heel side and a toe side that are disposed in the undercuts. The face member includes a rail on a sole side that is disposed in an undercut in the sole side wall of the recess, and the face member includes a rail on a top line side that is disposed in an undercut defined by the top line key.

In another embodiment, a golf club head comprises a body, a face member, a top line key, and a threaded fastener. The body includes a recess having a heel side wall, a toe side wall, and a sole side wall defining a face support slot that is opened to a top line portion of the body. The body defines a threaded bore in a toe portion of the body. The face member is disposed in the face support slot and defines a ball striking surface. A plurality of score lines are recessed into the face member from the ball striking surface. The top line key forms a portion of a top line of the golf club head and extends in a heel to toe direction. The top line key defines an aperture in a toe portion of the top line key that aligns with the threaded bore of the body. The threaded fastener extends through the aperture of the top line key and is threaded into the threaded bore of the body. The fastener extends through the top line key and into the body to couple the top line key to the body. The top line key closes the opening of the face support slot, so that the face member is circumscribed by the heel side wall, the toe side wall, the sole side wall and the top line key. The top line key includes a projection on a heel end of the top line key that is received in an undercut disposed in a top line portion of the body. The top line key includes a keyed surface on a heel end of the top line key that abuts a keyed surface on the top line portion of the body, and the abutment between the keyed surfaces prevents relative motion between the heel end of the top line key and a heel portion of the body in a face to rear direction.

A golf club head comprises a body, a face, a toe cap, and a threaded fastener. The body includes a recess having a top line side wall, a heel side wall, and a sole side wall defining a face support slot that is opened to a toe portion of the body. The body defines a fastener bore that extends into the toe end of the body and includes a threaded portion. The face member is disposed in the face support slot and defines a ball striking surface, and a plurality of score lines are recessed into the face member from the ball striking surface. The toe cap forms a toe portion of the golf club head, and the toe cap defines a through bore that aligns with the threaded bore of the body. The threaded fastener extends through the through bore of the toe cap and is threaded into the threaded portion of the fastener bore of the body. The fastener extends through the toe cap and into the body to couple the toe cap to the body. The toe cap closes the opening of the face support slot, so that the face member is circumscribed by the top line side wall, the heel side wall, the sole side wall and the toe cap.

In another embodiment, a golf club head comprises a body, a face member, a toe cap, and a threaded fastener. The body includes a recess having a top line side wall, a heel side wall, and a sole side wall defining a face support slot that is opened to a toe portion of the body. The body defines a fastener bore that extends into the toe end of the body and includes a threaded portion. The face member is disposed in the face support slot and defines a ball striking surface. A plurality of score lines are recessed into the face member from the ball striking surface. The toe cap forms a toe portion of the golf club head, and defines a through bore that aligns with the threaded bore of the body. The threaded fastener extends through the through bore of the toe cap and is threaded into the threaded portion of the fastener bore of the body. The fastener extends through the toe cap and into the body to couple the toe cap to the body. The toe cap closes the opening of the face support slot, so that the face member is circumscribed by the top line side wall, the heel side wall, the sole side wall and the toe cap. The top line side wall of the recess defines an undercut, the sole side wall of the recess defines an undercut, and the face member includes rails on a top line side and a sole side that are disposed in the undercuts. The face member includes a rail on a heel side that is disposed in an undercut in the sole side wall of the recess, and the face member includes a rail on a toe side that is disposed in an undercut defined in the toe cap.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENTS

Figure 1:
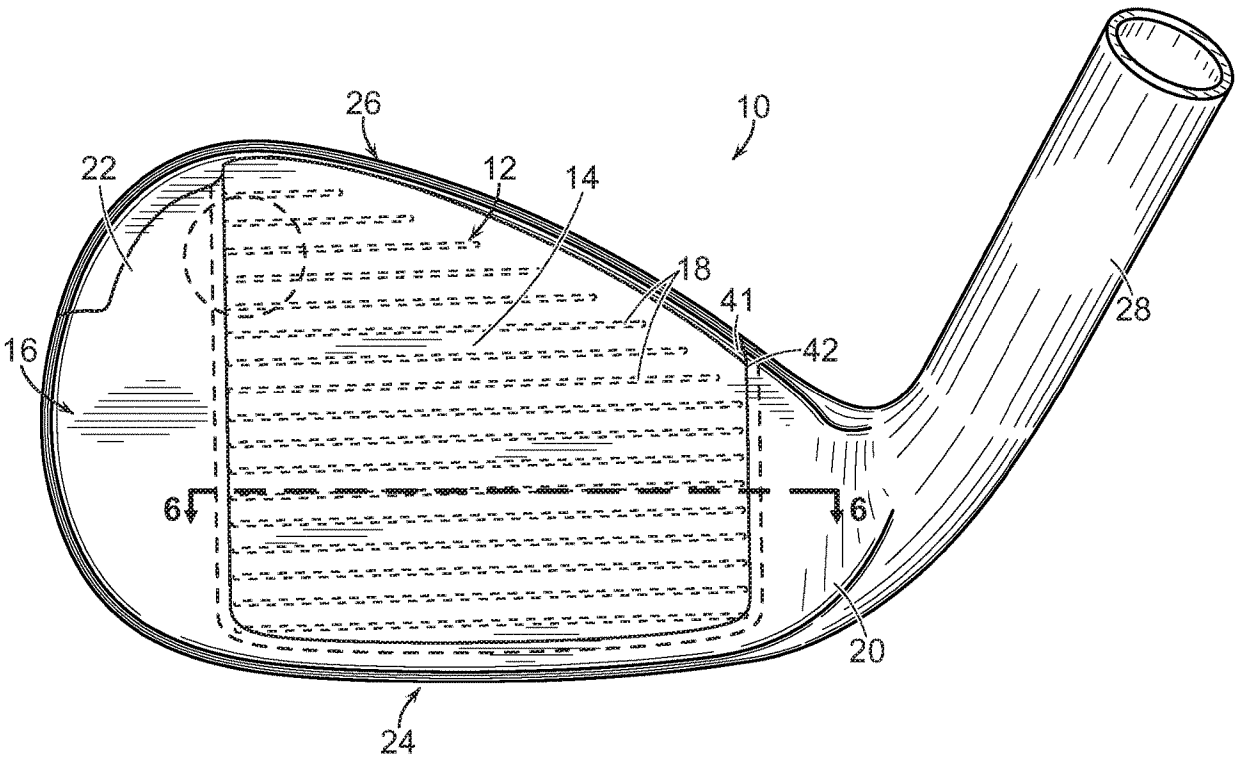
FIG. 1 is a front view of a golf club head in accordance with the present invention.
Figure 2:
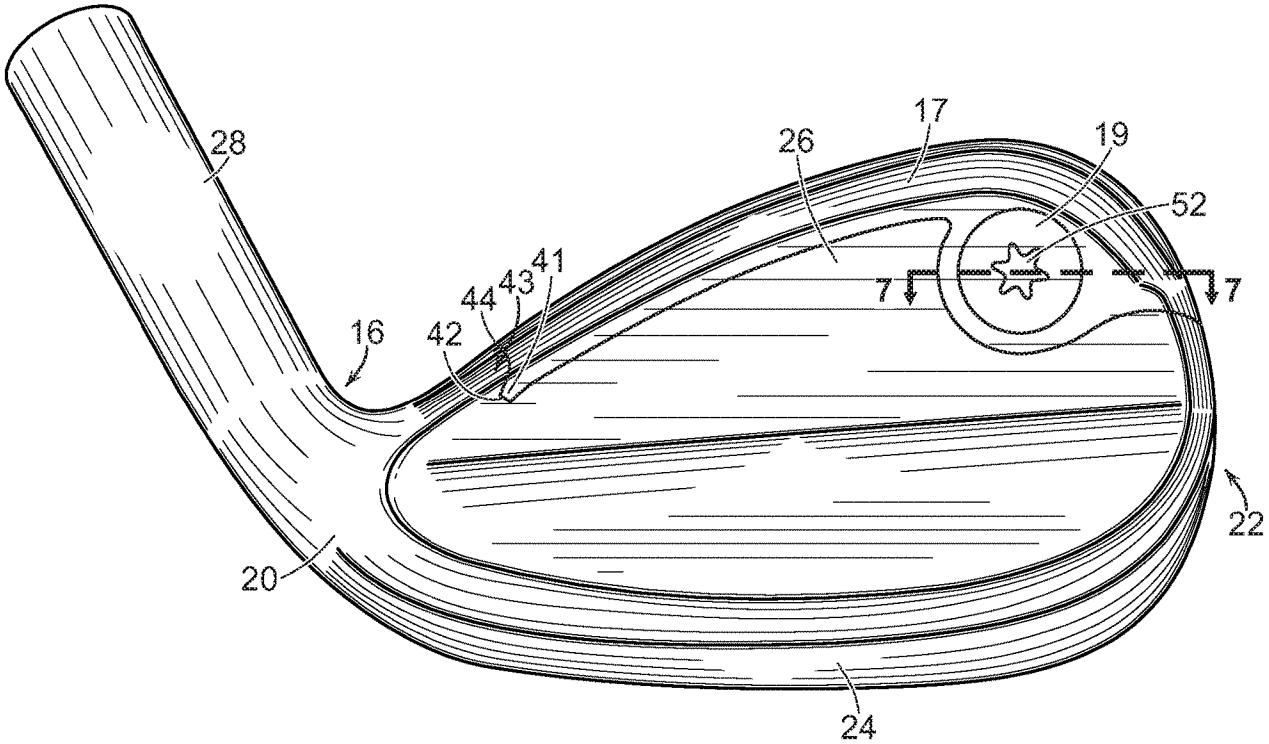
FIG. 2 is a rear view of the golf club head of FIG. 1.
Figure 3:
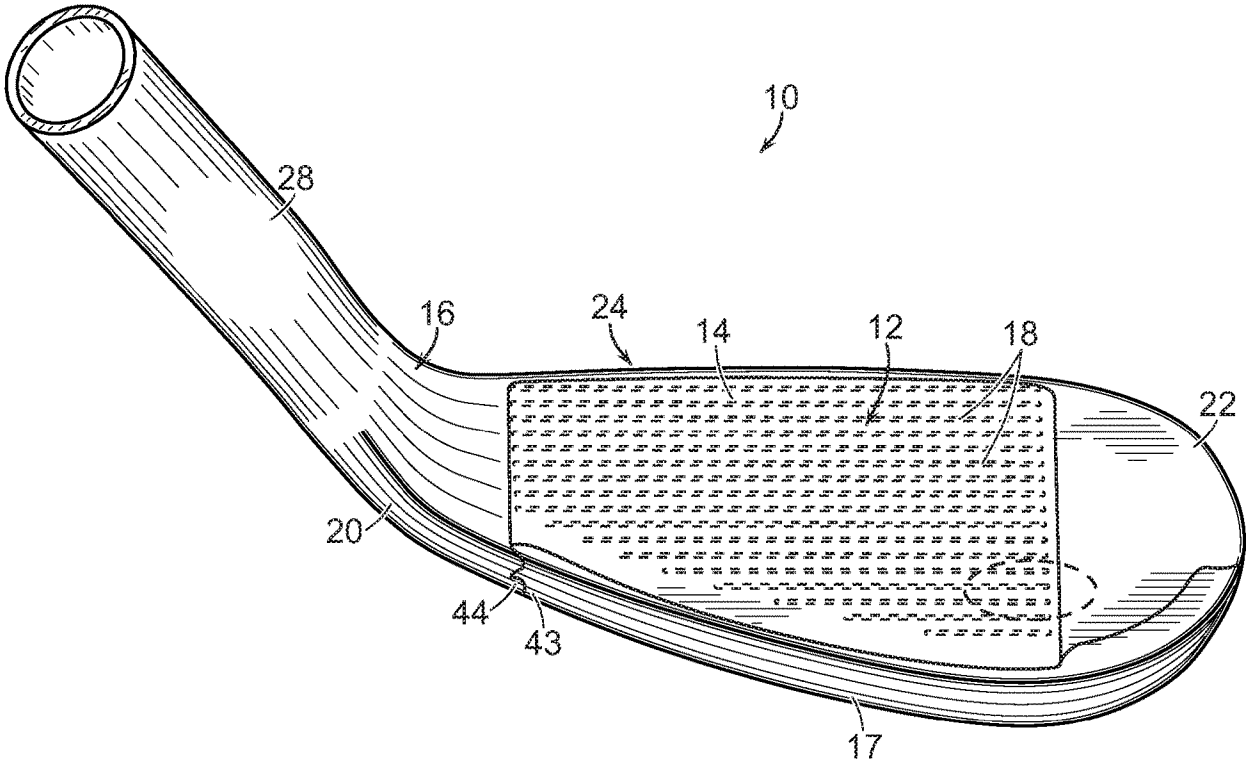
FIG. 3 is a top view of the golf club head of FIG. 1.
Figure 4:
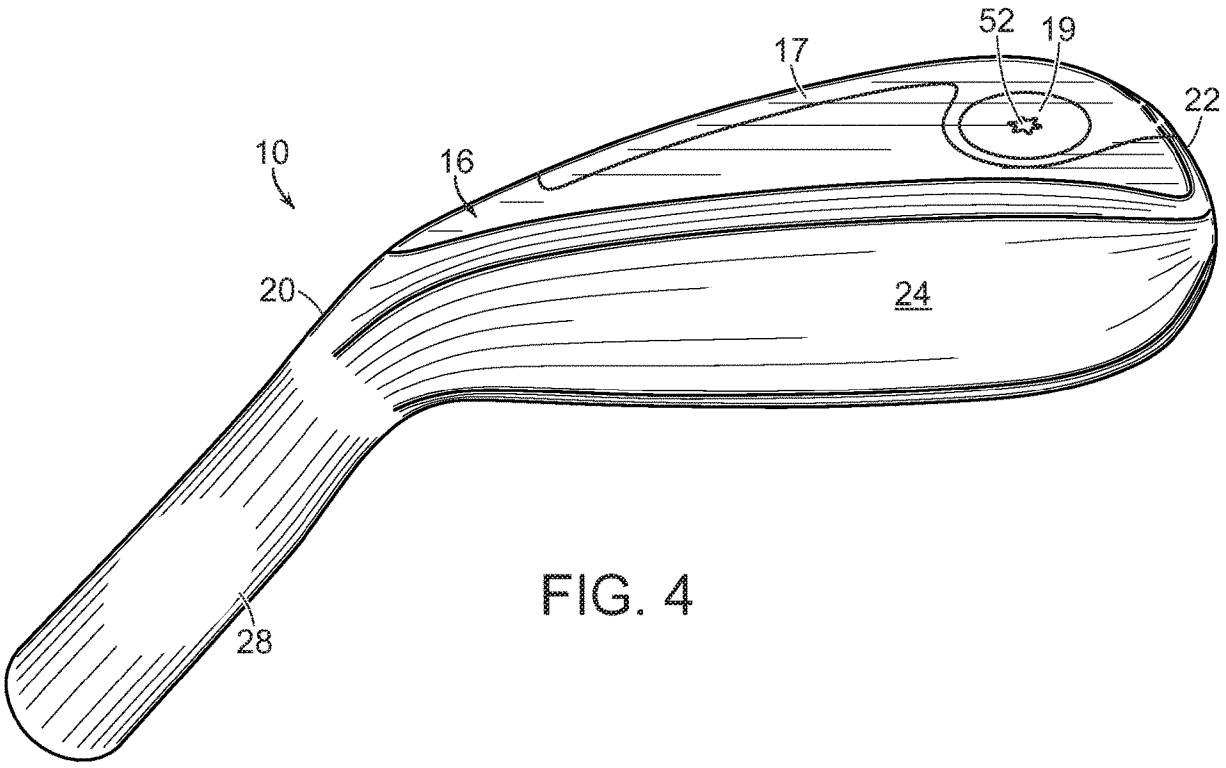
FIG. 4 is a bottom view of the golf club head of FIG. 1.
Figure 5:
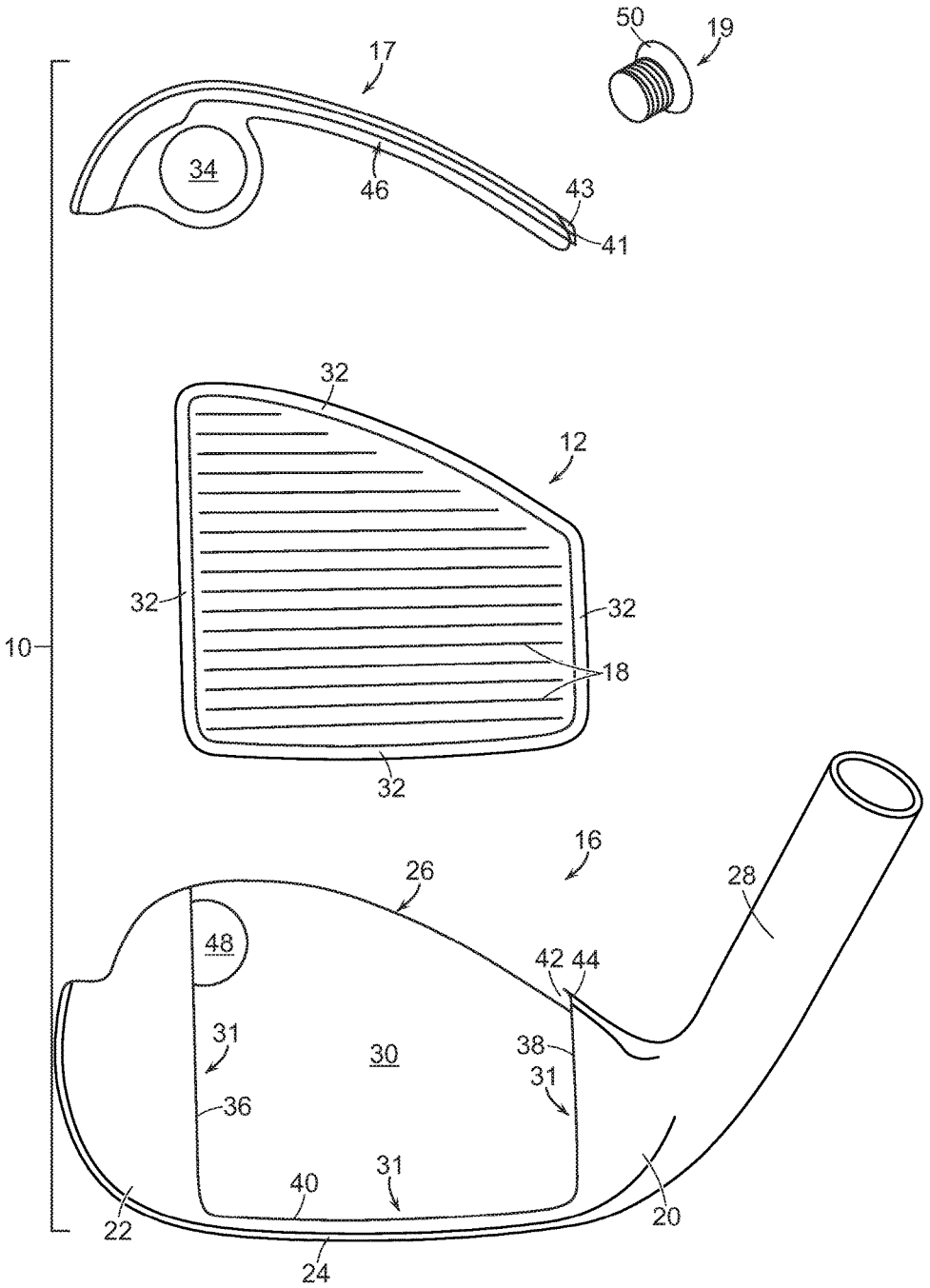
FIG. 5 is a front exploded view of the golf club head of FIG. 1.

The present invention is directed to modular golf clubs. In particular, the inventive golf clubs generally include a multi-component structure that allows various attributes to be altered. In an aspect of the present invention, the multi-component structure allows a face member to be replaced to alter, at least in part, mass properties, materials, visual attributes, surface texture, and/or scoreline geometry.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Referring to FIGS. 1-7, a golf club head 10 having an iron-type construction, and more particular a wedge-type construction, that includes a removable face member will be described. The golf club head generally includes a face member 12 and a body 16 that supports the face member 12, a top line key 17 and a fastener 19. The face member 12 includes a generally planar ball striking surface 14 and a plurality of score lines 18, or grooves, a rear surface and a side wall that extends between the ball striking surface 14 and the rear surface 15. The score lines 18 extend into the face member 12 from the ball striking surface 14. The score lines 18 assist in imparting spin to a golf ball during impact and may have various configurations to produce desired spin characteristics. A portion of the body 16 forms a hosel 28 for attaching a golf club shaft when the head is assembled into a golf club.

The body 16 provides the majority of the mass of club head 10 and is configured to distribute the mass so that club head has a desired behavior during impact with a golf ball and/or the ground during a swing. However, the total mass and the distribution of the mass of the golf club head 10 may be altered by selecting the material and/or geometry of the face member 12 and/or fastener 19 of the present invention. For example, a selection of fasteners 19 having different masses may be provided and used to compensate for grips and/or shafts having different masses, while maintaining the overall mass of the golf club. The body 16 may have a muscle-back or a cavity-back configuration so that the forgiveness and playability may be tuned. As shown, body 16 has a muscle-back configuration, but it should be appreciated that it may alternatively have a cavity-back configuration that provides perimeter weighting to increase the moment of inertia of the club head to add forgiveness during misaligned ball impacts. The mass of body 16 is concentrated below the geometric center in a sole portion 24.

Figure 6:
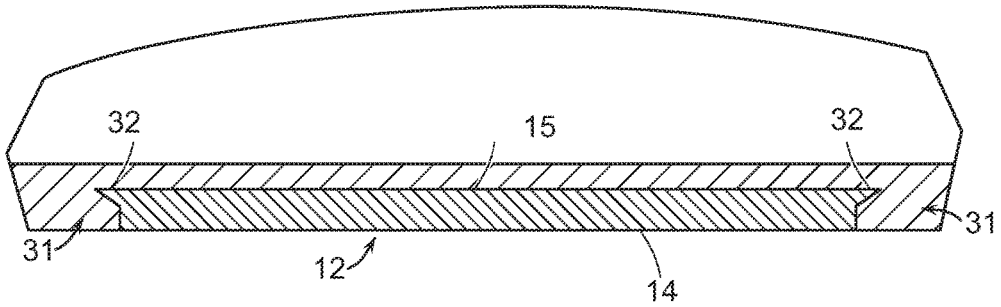
FIG. 6 is a cross-sectional view of a portion of the golf club head of FIG. 1, corresponding to line 6-6 shown in FIG. 1.

The body 16 also includes a face support slot 30 that is recessed into a front surface of the body 16. The face support slot 30 intersects a top line portion 26 of the body 16 so that the slot is open toward the front of the golf club head and toward the top line portion 26. In the present embodiment, the face support slot 30 defines a toe side wall 36, a heel side wall 38, and a sole side wall 40. The side walls of the face support slot 30 include lateral undercuts 31. The undercuts 31 are sized and shaped to receive rails 32 that are included on the perimeter of the face member 12, as shown in FIG. 6.

The opening of the face support slot 30 at the top of the club head body 16 allows the face member 12 to be slid into the face support slot 30 from the top of the golf club head toward the sole. The rails 32 included on the heel and toe sides of the face member 12 slide into the undercuts 31 included on the heel and toe side walls 36, 38 of the face support slot 30 until a sole side of the face member 12 abuts the sole side wall 40 of the face support slot 30. Preferably, the sole side wall 40 of the face support slot 30 includes an undercut 31 that receives a rail 32 included on the sole side of the face member 12. In the illustrated embodiment, the undercuts 31 are shaped so that the face support slot 30 is generally formed as a shallow and wide dovetail slot. In other words, the undercuts are generally triangular in shape and tapered so that they extend deeper into the side walls further to the rear of the club head body 16. The tapered shape of the undercuts 31 prevents movement of the face member 12 relative to the club head body 16 in heel to toe and front to back directions when the face member is installed. It should be appreciated that the undercuts and rails need not be tapered, and may be formed as stepped shoulders on the face member and stepped undercuts in the side walls of the face support slot.

As described above the face support slot is opened to the top of the club head body 16 and the face member 12 is slid into the face support slot 30 from the top. After the face member 12 is slid into the face support slot 30, the top line key 17 is coupled to the body 16 to retain the face member 12 in the face support slot 30. In that configuration, the face member 12 is bound by the face support slot 30 and the top line key 17, but the front ball striking surface 14 remains exposed.

The top line key 17 is removably affixed to the body 16 to retain the face member 12 in the face support slot 30. The top line key 17 forms a portion of a top line of the golf club head 10 and extends from a heel side of the face support slot 30 to a toe side of the face support slot 30. The heel side of the top line key 17 includes a projection 41 and a keyed surface 43 that complement and engage an undercut 42 and a keyed surface 44 of the body 16 disposed in a heel portion 20 of the body 16. The interaction between the projection 41 and the undercut 42 prevent the heel end of the top line key 17 from separating from the body 16 in an upward direction while allowing the toe end of the top line key 17 to slide into position in a toe to heel direction, and to slightly rotate down toward body 16 into a position that allows the fastener 19 to be installed. Similarly, the keyed surface 43 of the top line key 17 engages the keyed surface 44 of the body 16 to prevent the top line key 17 from moving relative to the body 16 in a forward to back (i.e., face to rear) direction while allowing the top line key 17 to be slid in a toe to heel direction during installation.

Additionally, the top line key 17 includes an aperture 34 at a toe side that receives fastener 19 and is used to lock the top line key 17 into a position that retains the face member 12. The aperture 34 is a through bore disposed on the toe end of the top line key 17. The aperture 34 is positioned so that when the top line key 17 is installed on the body 16, the aperture 34 aligns with a threaded fastener bore 48 disposed in the toe portion 22 of the body 16. The top line key 17 may also include an undercut 46 similar to the undercuts 31 of the body 16. The undercut 46 of the top line key aligns with, and receives, a rail 32 included on the upper perimeter of the face member 12 when the top line key 17 is installed.

Figure 7:
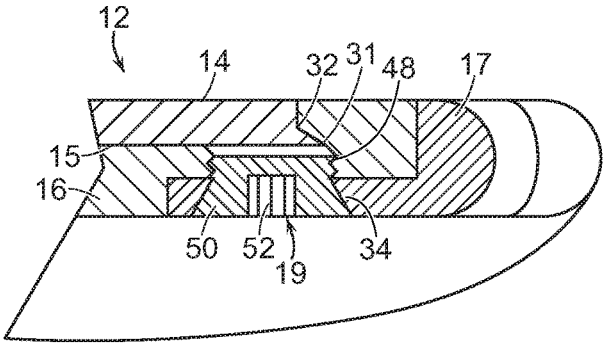
FIG. 7 is a cross-sectional view of a portion of the golf club head of FIG. 1, corresponding to line 7—shown in FIG. 2.

After the face member 12 is slid into the face support slot 30 and the top line key 17 is installed, the fastener 19 is inserted into the aperture 34 and threaded into the threaded fastener bore 48 of the body 16, as shown in FIG. 7. A tool that engages a tool engagement feature 52 on the head of the fastener 19 is used to install the fastener 19. Threading the fastener 19 into the body 16 fully locks the top line key 17, face member 12 and body 16 to each other so that the golf club head 10 is fully assembled.

Various features may be included in the construction so that the components are forced together during assembly. For example, the fastener 19 may include a tapered head 50. The face member 12 may be dimensioned so that as fastener 19 is threaded into the threaded fastener bore 48 the tapered abutment between the fastener head 50 and the aperture 34 of the top line key 17 draw the top line key toward the sole and tightly against the top edge of the face member 12. In addition, or as an alternative, an elastic material may be interposed between the face member 12 and the body 16 at the interaction locations between the rails 32 of the face member 12 and the undercuts of the body 16 and/or top line key 17. The elastic material is configured so that it is compressed during the assembly of the components to prevent relative movement between the components after assembly. It should be appreciated that the elastic material may be included as discrete pads or continuous filling at the rail/undercut interfaces. It should further be appreciated that the threaded fastener and the threaded fastener bore may be replaced with alternative fasteners, such as a quarter-turn fastener.

Another golf club head including a removable face is illustrated in FIGS. 8-12. The golf club head 60 generally includes a face member 62, a body 64 that supports the face member 62, a toe cap 66 and a fastener 68. The face member 62 includes a generally planar ball striking surface 63 and a plurality of score lines 70, or grooves, a rear surface 72 and a side wall that extends between the ball striking surface 63 and the rear surface 72. The score lines 70 extend into the face member 62 from the ball striking surface 63. The score lines 70 assist in imparting spin to a golf ball during impact and may have various configurations to produce desired spin characteristics. A portion of the body 64 forms a hosel 74 for attaching a golf club shaft when the head is assembled into a golf club.

The body 64 defines a top line portion 76 and a sole portion 78, and provides the majority of the mass of club head 60. The body 64 is configured to distribute the mass so that club head has a desired behavior during impact with a golf ball and/or the ground during a swing. As shown, body 16 has a muscle-back configuration, but it should be appreciated that it may alternatively have a cavity-back configuration that provides perimeter weighting to increase the moment of inertia of the club head to add forgiveness during misaligned ball impacts.

Figure 10:
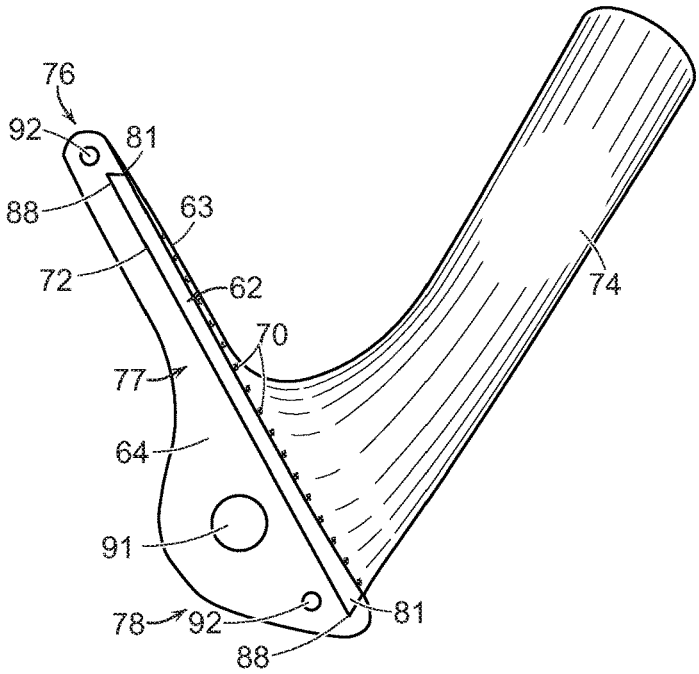
FIG. 10 is a side view of a portion of the golf club head of FIG. 8, from an interface between a body and a toe cap of the golf club head.
Figure 11:
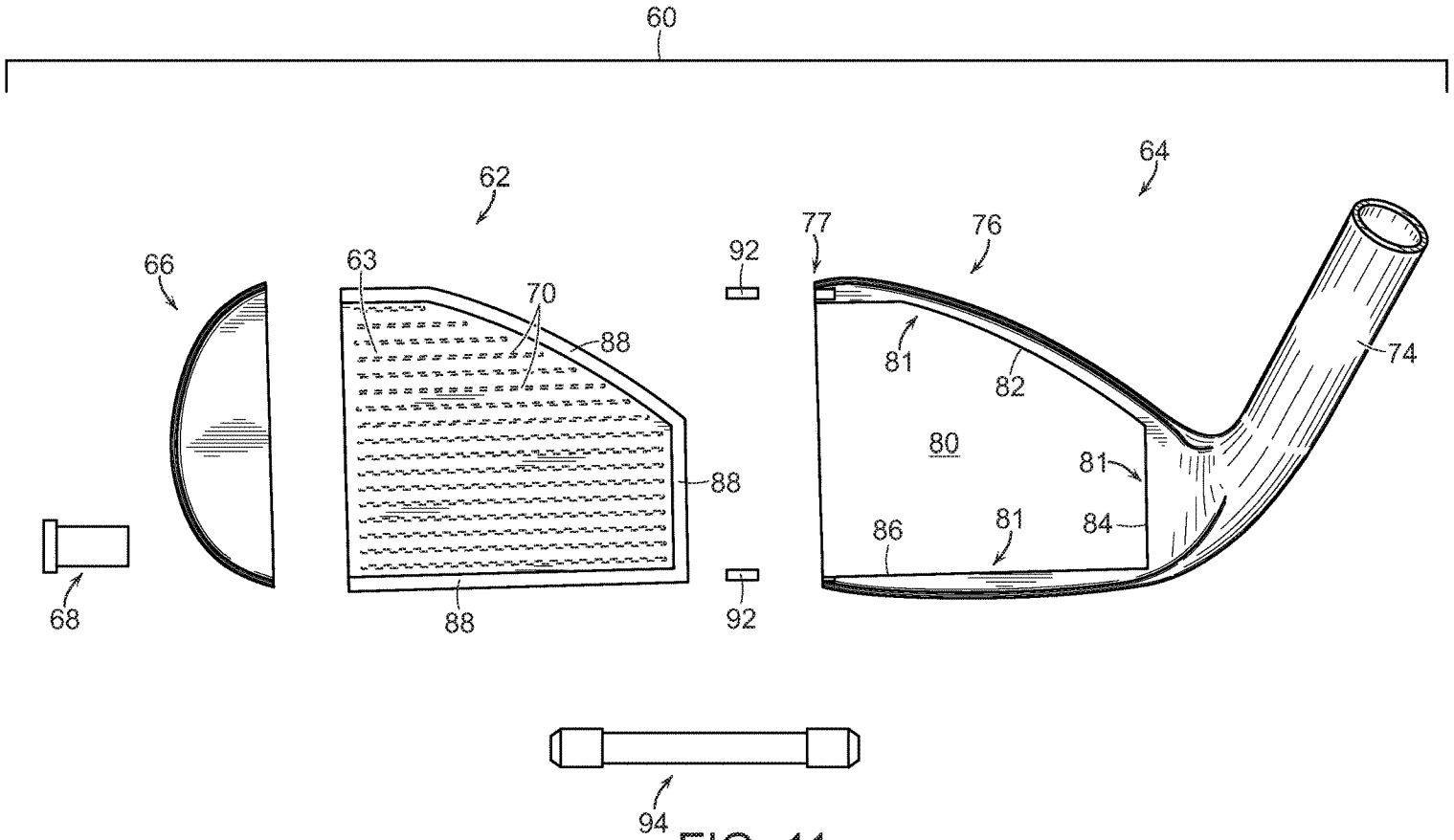
FIG. 11 is an exploded view of the golf club head of FIG. 8.

The body 64 also includes a face support slot 80 that is recessed into a front surface of the body 64. The face support slot 80 intersects a toe portion 77 of the body 64 so that the slot is open toward the front of the golf club head and toward the toe portion 77. In the present embodiment, the face support slot 80 defines a top line side wall 82, a heel side wall 84, and a sole side wall 86. The side walls of the face support slot 80 include lateral undercuts 81. The undercuts 81 are sized and shaped to receive rails 88 that are included on the perimeter of the face member 62, as shown in FIGS. 10 and 11.

The opening of the face support slot 80 at the toe side of the club head body 64 allows the face member 62 to be slid into the face support slot 80 from the toe side of the golf club head toward the hosel 74. The rails 88 included on the top line and sole sides of the face member 62 slide into the undercuts 81 included on the top line and sole side walls 82, 86 of the face support slot 80 until a heel side of the face member 62 abuts the heel side wall 84 of the face support slot 80. Preferably, the heel side wall 84 of the face support slot 80 includes an undercut 81 that receives a rail 88 included on the heel side of the face member 62. In the illustrated embodiment, the undercuts 81 are shaped so that the face support slot 80 is generally formed as a shallow and wide dovetail slot. In other words, the undercuts are generally triangular in shape and tapered so that they extend deeper into the side walls further to the rear of the club head body 64. The tapered shape of the undercuts 81 prevents movement of the face member 62 relative to the club head body 64 in top line to sole and front to back directions when the face member is installed. It should be appreciated that the undercuts and rails need not be tapered, and may be formed as stepped shoulders on the face member and stepped undercuts in the side walls of the face support slot, and further that an elastic material may be interposed between at least one side of the face member and at least one side wall of the recess in the body.

As described above, the face support slot is opened to the toe of the club head body 64 and the face member 62 is slid into the face support slot 80 from the toe side. After the face member 62 is slid into the face support slot 80, the toe cap 66 is coupled to the body 64 to retain the face member 62 in the face support slot 80. In that configuration, the face member 62 is bound by the face support slot 80 and the toe cap 66, but the front ball striking surface 63 remains exposed.

The toe cap 66 is coupled to the body 64 using fastener 68. In particular, toe cap 66 includes a through bore 90 that generally extends in a heel to toe direction through the toe cap 66. In the present embodiment, the through bore 90 is located in a lower sole portion of the toe cap 66 and the fastener 68 extends through the through bore 90 and into a bore 91 included in the body 64. The bore 91 that extends into the body 64 may be at least partially threaded to engage a threaded fastener 68. Alternatively, the bore 91 may include features to engage another type of fastener, such as a quarter turn type fastener. The size of the fastener 68 may be selected based on the desired geometry of the golf club head, and in the present embodiment, a larger fastener 68 may be incorporated because the sole portion of the golf club head 60 is a thick portion of the golf club head and allows the use of a larger fastener. It should be appreciated that a smaller fastener, or multiple smaller fasteners may be employed.

Figure 8:
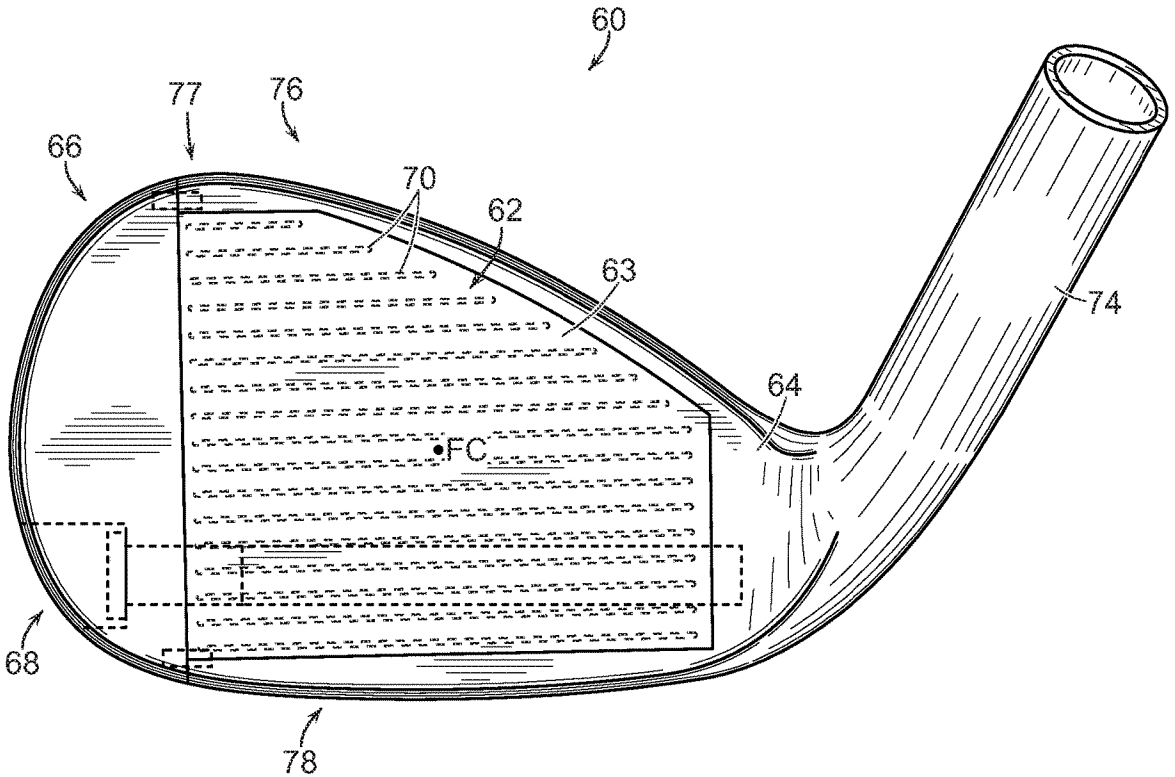
FIG. 8 is a front view of a golf club head in accordance with the present invention.
Figure 9:
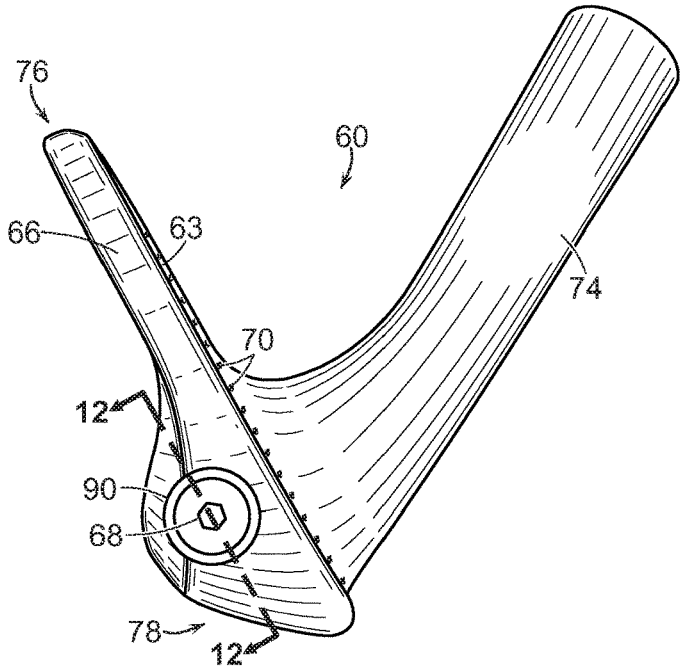
FIG. 9 is a side view of the golf club head of FIG. 8.
Figure 12:
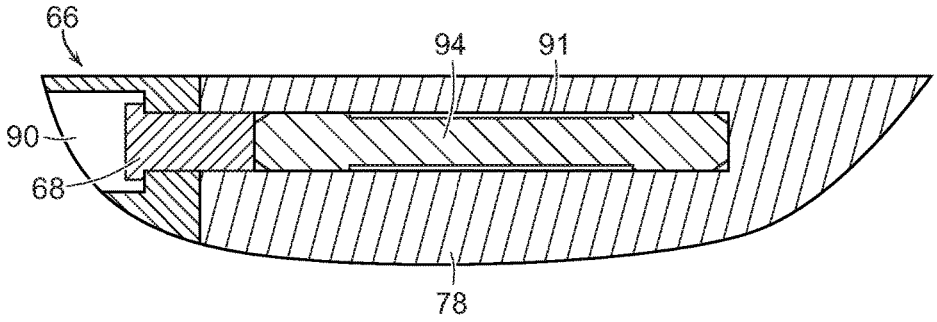
FIG. 12 is a cross-sectional view of a portion of the golf club head of FIG. 8, corresponding to line 12-12 shown in FIG. 9.

The bore 91 that extends into the body 64 may be constructed so that it accommodates adjustable weighting in addition to the fastener 68. For example, as shown in FIGS. 8 and 12, the bore 91 may extend across a large portion of the body in a heel to toe direction from the interface with the toe cap, e.g., the bore 91 may extend from the interface past a vertical plane extending through the geometric face center FC and normal to the ball striking surface 63. The bore 91 may be configured to receive an elongate weight member 94 and the fastener 68 captures the weight member 94 within the bore 91 when it is coupled to the body 64. The elongate weight member 94 may be configured to have a center of gravity in a central location or biased to one side or the other, thereby allowing the center of gravity of the golf club head to be manipulated using the elongate weight member 94. As an alternative, the elongate weight member may be replaced with a viscoelastic filler material. Still further, it should be appreciated that in some embodiments, the golf club may not be configured to accommodate an elongate weight member and in those embodiments the bore 91 of the golf club head need not be longer than necessary to couple the toe cap 66 with fastener 68. Additionally, fastener 68 may be selected from a plurality of fasteners having different constructions (e.g., such as by including recesses to alter the volume) and/or materials so that they have different masses to alter the overall mass of the golf club head 60, such as to alter the swing weight of a golf club assembled with the golf club head. Additionally, a plurality of toe caps 66 having different construction (e.g., such as by including recesses to alter the volume) and/or material may be provided so that the mass of the toe cap 66 may be selected to alter the overall mass of the golf club head, thereby allowing the alteration of the swingweight of a golf club incorporating the golf club head. As a further alternative, the fastener may be rotatably coupled to the toe cap so that it does not become separated from the toe cap when the golf club head is disassembled. For example, a spring retaining ring may be disposed within aligned circumferential channels in a head of the fastener 68 and the bore 90 of the toe cap to rotatably couple the fastener to the toe cap.

In addition to fastener 68, a plurality of alignment features, such as alignment pins 92, are included that align the interface between the toe cap 66 and the body 64. Alignment pins 92 extend across the interface between the toe cap 66 and the body 64 and are disposed in holes in the toe cap 66 and the body 64 that have diameters closely matching the diameters of the alignment pins 92 so that the toe cap 66 and body 64 are held precisely relative to each other. The alignment pins 92 may be permanently coupled to one of the toe cap 66 and the body 64 so that they form a permanent projection that engages a complementary recess in the other of the toe cap 66 and the body 64. As a further alternative, the alignment pins 92 may be replaced by other alignment features, such as at least one projection machined or cast into the toe cap 66 and/or body 64 that complements a recess machined or cast into the other of the toe cap 66 and the body 64, for example forming a parallel tongue and groove coupling. As another alternative, the face member 62 may include a toe side rail that extends into a beveled groove, or undercut, in the toe cap 66.

While it is apparent that the illustrative embodiments of the invention disclosed herein fulfill the objectives stated above, it is appreciated that numerous modifications and other embodiments may be devised by those skilled in the art. Elements from one embodiment can be incorporated into other embodiments. Therefore, it will be understood that the appended claims are intended to cover all such modifications and embodiments, which would come within the spirit and scope of the present invention.

I claim:

1. A golf club head, comprising:

a body including a recess having a top line side wall, a heel side wall, and a sole side wall defining a face support slot that is opened to a toe portion of the body, wherein the body defines a fastener bore that extends into the toe end of the body and includes a threaded portion;

a face member disposed in the face support slot and defining a ball striking surface, wherein a plurality of score lines are recessed into the face member from the ball striking surface;

a toe cap that forms a toe portion of the golf club head, wherein the toe cap defines a through bore that aligns with the threaded bore of the body; and a threaded fastener that extends through the through bore of the toe cap and is threaded into the threaded portion of the fastener bore of the body, wherein the fastener extends through the toe cap and into the body to couple the toe cap to the body, and wherein the toe cap closes the opening of the face support slot, so that the face member is circumscribed by the top line side wall, the heel side wall, the sole side wall and the toe cap.

2. The golf club head of claim 1, wherein the top line side wall of the recess defines an undercut, wherein the sole side wall of the recess defines an undercut, and wherein the face member includes rails on a top line side and a sole side that are disposed in the undercuts.

3. The golf club head of claim 2, wherein the face member includes a rail on a heel side that is disposed in an undercut in the sole side wall of the recess.

4. The golf club head of claim 2, wherein the face member includes a rail on a toe side that is disposed in an undercut defined in the toe cap.

5. The golf club head of claim 2, wherein the undercuts on the top line side wall and the sole side wall are tapered so that the face support slot is a dovetail slot.

6. The golf club head of claim 1, wherein the toe cap includes an alignment feature that is a projection extending from a side wall that is received in a recess disposed in a side wall of the body.

7. The golf club head of claim 1, further comprising an alignment pin disposed in a first bore in the toe cap and a second bore in the body, wherein the alignment pin extends across the interface between the toe cap and the body.

8. The golf club head of claim 1, wherein the fastener bore of the body extends in a heel to toe direction past the geometric face center of the golf club head.

9. The golf club head of claim 8, further comprising an elongate weight disposed in the fastener bore and captured by the fastener.

10. The golf club head of claim 8, further comprising a viscoelastic material disposed in the fastener bore.

11. The golf club head of claim 1, further comprising elastic material interposed between at least one side of the face member and at least one side wall of the recess in the body.

12. A golf club head, comprising:

a body including a recess having a top line side wall, a heel side wall, and a sole side wall defining a face support slot that is opened to a toe portion of the body, wherein the body defines a fastener bore that extends into the toe end of the body and includes a threaded portion;

a face member disposed in the face support slot and defining a ball striking surface, wherein a plurality of score lines are recessed into the face member from the ball striking surface;

a toe cap that forms a toe portion of the golf club head, wherein the toe cap defines a through bore that aligns with the threaded bore of the body; and a threaded fastener that extends through the through bore of the toe cap and is threaded into the threaded portion of the fastener bore of the body, wherein the fastener extends through the toe cap and into the body to couple the toe cap to the body, wherein the toe cap closes the opening of the face support slot, so that the face member is circumscribed by the top line side wall, the heel side wall, the sole side wall and the toe cap, wherein the top line side wall of the recess defines an undercut, wherein the sole side wall of the recess defines an undercut, and wherein the face member includes rails on a top line side and a sole side that are disposed in the undercuts, wherein the face member includes a rail on a heel side that is disposed in an undercut in the sole side wall of the recess, and wherein the face member includes a rail on a toe side that is disposed in an undercut defined in the toe cap.

13. The golf club head of claim 12, wherein the undercuts on the top line side wall and the sole side wall are tapered so that the face support slot is a dovetail slot.

14. The golf club head of claim 12, wherein the toe cap includes an alignment feature that is a projection extending from a side wall that is received in a recess disposed in a side wall of the body.

15. The golf club head of claim 12, further comprising an alignment pin disposed in a first bore in the toe cap and a second bore in the body, wherein the alignment pin extends across the interface between the toe cap and the body.

16. The golf club head of claim 12, wherein the fastener bore of the body extends in a heel to toe direction past the geometric face center of the golf club head.

17. The golf club head of claim 16, further comprising an elongate weight disposed in the fastener bore and captured by the fastener.

18. The golf club head of claim 16, further comprising a viscoelastic material disposed in the fastener bore.

19. The golf club head of claim 12, further comprising elastic material interposed between at least one side of the face member and at least one side wall of the recess in the body.

* * * * *